United States Patent [19]

Erbstoesser

[11] 4,102,401

[45] Jul. 25, 1978

[54] WELL TREATMENT FLUID DIVERSION WITH LOW DENSITY BALL SEALERS

[75] Inventor: Steven R. Erbstoesser, Houston, Tex.

[73] Assignee: Exxon Production Research Company, Houston, Tex.

[21] Appl. No.: 830,729

[22] Filed: Sep. 6, 1977

[51] Int. Cl.[2] ..... E21B 33/10; E21B 43/25

[52] U.S. Cl. ..... 166/284; 137/268; 166/192

[58] Field of Search ..... 166/284, 281, 193, 192, 166/153, 179, 285, 292, 295, 305 R; 138/89; 137/268; 273/58 R, 58 A, 230

[56] References Cited

U.S. PATENT DOCUMENTS

| | | | |
|---|---|---|---|
| 2,754,910 | 7/1956 | Derrick et al. | 166/284 |
| 2,933,136 | 4/1960 | Ayers et al. | 166/284 |
| 3,010,514 | 11/1961 | Fox | 166/284 |
| 3,086,587 | 4/1963 | Zandmer et al. | 166/284 |
| 3,144,049 | 8/1964 | Ginsburgh | 166/284 X |
| 3,174,546 | 3/1965 | Flickinger | 166/284 X |
| 3,301,327 | 1/1967 | Patton et al. | 166/305 R |
| 3,376,934 | 4/1968 | Willman et al. | 166/284 X |
| 3,437,147 | 4/1969 | Davies | 166/284 |
| 3,645,331 | 2/1972 | Maurer et al. | 166/193 X |

*Primary Examiner*—Stephen J. Novosad
*Attorney, Agent, or Firm*—Gary D. Lawson

[57] ABSTRACT

A ball sealer for use as a diverting agent when treating a well having a perforated casing. The ball sealer is sized to plug a perforation and has a density less than the treating fluid. The ball sealer is made of a core material, such as syntactic foam or polymethylpentene, and a covering of a thin layer of an elastomeric material. After some of the treating fluid has been injected into the well, the ball sealers are injected and carried by the fluid flow down to the perforations where they seat and divert the further injection of treating fluid through the remaining open perforations.

8 Claims, 5 Drawing Figures

WELL TREATMENT FLUID DIVERSION WITH LOW DENSITY BALL SEALERS

BACKGROUND OF THE INVENTION

1. Field of the Invention

This invention pertains to the treating of wells and more in particular to the sequential treatment of formation strata by the temporary closing of perforations in the well casing during the treatment.

2. Description of the Prior Art

It is common practice in completing oil and gas wells to set a string of pipe, known as casing, in the well and use cement around the outside of the casing to isolate the various formations penetrated by the well. To establish fluid communication between the hydrocarbon bearing formations and the interior of the casing, the casing and cement sheath are perforated.

At various times during the life of the well, it may be desirable to increase the production rate of hydrocarbons through acid treatment or hydraulic fracturing. If only a short, single pay zone in the well has been perforated, the treating fluid will flow into the pay zone where it is required. As the length of the perforated pay zone or the number of perforated pay zones increases, the placement of the fluid treatment in the regions of the pay zones where it is required becomes more difficult. For instances, the strata having the highest permeability will most likely consume the major portion of a given stimulation treatment leaving the least permeable strata virtually untreated. Therefore, techniques have been developed to divert the treating fluid from its path of least resistance so that the low permeability zones are also treated.

One technique for achieving diversion involves the use of downhole equipment such as packers. Although these devices are effective, they are quite expensive due to the involvement of associated workover equipment required during the tubing-packer manipulations. Additionally, mechanical reliability tends to decrease as the depth of the well increases.

As a result, considerable effort has been devoted to the development of alternative diverting methods. One of the most popular and widely used diverting techniques over the past 20 years has been the use of small rubber-coated balls, known as ball sealers, to seal off the perforations inside the casing.

These ball sealers are pumped into the wellbore along with the formation treating fluid. The balls are carried down the wellbore and on to the perforations by the flow of the fluid through the perforations into the formation. The balls seat upon the perforations and are held there by the pressure differential across the perforation.

The major advantages of utilizing ball sealers as a diverting agent are: easy to use, positive shutoff, independent of the formation, and non-damaging to the well. The ball sealers are simply injected at the surface and transported by the treating fluid. Other than a ball injector, no special or additional treating equipment is required. The ball sealers are designed to have an outer covering sufficiently compliant to seal a jet formed perforation and to have a solid, rigid core which resists extrusion into or through the perforation. Therefore, the ball sealers will not penetrate the formation and permanently damage the flow characteristics of the well.

Several requirements are repeatedly applied to ball sealers as they are normally utilized today. First, the ball sealers must be chemically inert in the environment to which they are exposed. Second, they must seal effectively, yet not extrude into the perforations. Third, the ball sealers must release from the perforations when the pressure differential into the formation is relieved. Fourth, the ball sealers are generally heavier than the wellbore fluid so that they will sink to the bottom of the well, and out of the way, upon completion of the treatment.

Although present-day ball sealer diverting techniques have met with considerable usage, there is abundant evidence which indicates that the sealing devices often do not perform effectively because only a fraction of the ball sealers injected actually seat on perforations. The present-day practice of using ball sealers having a density greater than the treating fluid yields a low and unpredictable seating efficiency highly dependent on the difference in density between the ball sealers and the fluid, the flow rate of the fluid through the perforations, and the number, spacing and orientation of the perforations. The net result is that the plugging of the desired number of perforations at the proper time during the treatment to effect the desired diversion is left completely to chance.

When these inefficiencies lead to treatment failures, it is generally believed that these failures result from insufficient flow being carried through the perforations, thereby allowing the balls to fall to the bottom of the well without achieving fluid diversion. Attempts to overcome this problem generally include pumping a quantity of balls which exceeds the number of perforations. Although this procedure can be helpful, it has not proven to be a satisfactory solution.

SUMMARY OF THE INVENTION

The method of the present invention overcomes the limitations of present-day ball sealer diversion methods. The present invention utilizes ball sealers having a density less than the treating fluid so that 100% seating efficiency can be achieved.

The method of the present invention involves flowing a treating fluid downward within the casing and through the perforations into the formation surrounding the perforated parts of the casing. At the appropriate time during the treatment, spherically-shaped plugging members, i.e., ball sealers, are introduced into the treating fluid at the surface. These ball sealers will have a size suffiicient to plug the casing perforations and a density less than the density of the treating fluid within the casing. Thereafter, the downward flow of the fluid within the casing will be continued at a rate such that the downward velocity of the fluid in the casing above the perforations is sufficient to impart a downward drag force on the ball sealers greater in magnitude than the upward buoyancy force acting on the ball sealers to thereby transport the ball sealers to the perforations. Once the ball sealers have reached the perforations, they will all seat on perforations taking fluid, plug the perforations and cause the treating fluid to be diverted to the remaining open perforations.

The ball sealers themselves must have a low density high strength core capable of withstanding the pressures existing within the well. The pressures acting on the ball sealers will be caused by the hydrostatic pressures of the fluid in the wellbore and the pumping pressure. The core material cannot collapse under the pressures in the well or else the ball sealers will decrease in volume and correspondingly have an increased density which can easily exceed the density of the treating fluid. It has been found that core materials that meet the density and strength requirements include syntaetic foam and polymethylpentene.

After the treatment of the hydrocarbon-bearing strata has been completed, the pressure on the fluid in the casing will be relieved causing the ball sealers to be released from the perforations where they were seated. The ball sealers will rise within the casing due to their buoyancy and to the upward flow of fluids from the well to the earth's surface. A ball catcher may be provided to trap all of the ball sealers upstream of any equipment which they might clog or damage.

The method of the present invention provides certainty in diversion heretofore unknown in well treatment operations.

DESCRIPTION OF THE PREFERRED EMBODIMENTS

Figure 1:
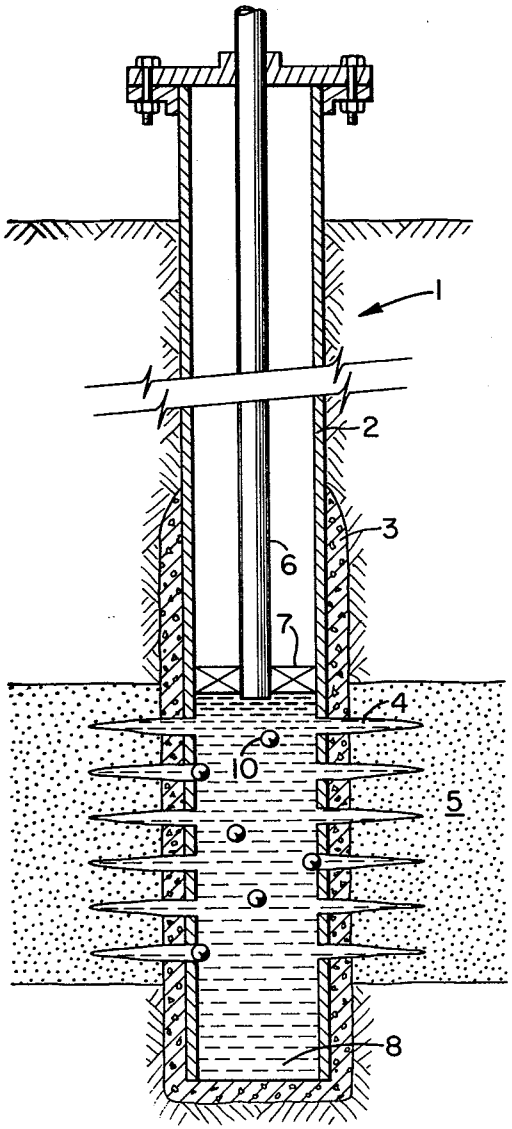
FIG. 1 is an elevation view in section of a well illustrating the practice of the present invention.

Utilization of the present invention according to the preferred embodiment is depicted in FIG. 1. The well 1 of FIG. 1 has a casing 2 run to the bottom of the wellbore and cemented around the outside to hold casing 2 in place and isolate the penetrated formations or intervals. The cement sheath 3 extends upward from the bottom of the wellbore at least to a point above the producing strata 5. For the hydrocarbons in the producing strata 5 to be produced, it is necesary to establish fluid communication between the producing strata 5 and the interior of the casing 2. This is accomplished by perforations 4 made through the casing 2 and the cement sheath 3.

The hydrocarbons flowing out of the producing strata 5 through the perforations 4 and into the interior of the casing 2 are transported to the surface through a production tubing 6. A production packer 7 is installed near the lower end of the production tubing 6 and above the highest perforation to achieve a pressure seal between the production tubing 6 and the casing 2. Production tubings are not always used and, in those cases, the entire interior volume of the casing is used to conduct the hydrocarbons to the surface of the earth.

When diversion is needed during a well treatment, ball sealers are often used to close off some of the perforations. These ball sealers are preferred to be approximately spherical in shape, but other geometries have been proposed.

To use the ball sealers 10 to plug some of the perforations 4, the first step is to introduce the ball sealers 10 into the casing 2 at a predetermined time during the treatment. The ball sealers can be mixed with the fluid either before or after the fluid is pumped into the upper end of the casing. Methods of accomplishing these procedures are well known in the art.

When the ball sealers 10 are introduced into the fluid upstream of the perforated parts of the casing, they are carried down the production tubing 6 or casing 2 by the fluid flow. Once the fluid arrives at the perforated parts of the casing, it moves radially outward, in addition to its downward movement, toward and through the perforations 4. The flow of the treating fluid through the perforations 4 carries the ball sealers 10 over to the perforations 4 and seats them on the perforations 4. The ball sealers 10 are held there by the fluid pressure differential, thereby effectively closing those perforations 4 until such time as the pressure differential is reversed. Ideally, the ball sealers 10 will first seal the perforations through which the treating fluid is flowing most rapidly This perferential closing of the perforations allows equal treatment of the producing strata through the entire distance of the perforations.

The prior art teaches that it is preferred for the density of the ball sealers to be greater than the density of the treating fluid. It is worth examining the prior art ball sealer seating mechanism to be able to contrast it to the present invention. The velocity of ball sealers more dense than the fluid in the wellbore is comprised of two components. Each ball sealers has a settling velocity which is due to the difference in the densities of the ball sealer and the fluid and is always a vertically downward velocity. The second component of the ball sealer's velocity is attributable to the drag forces imposed upon the ball sealer by the moving fluid shearing around the ball sealer. This velocity component will be in the direction of the fluid flow. Within the production tubing or within the casing above the perforations, the velocity component due to the fluid will be generally downward.

Just above the perforated part of the casing the fluid takes on a horizontal velocity component directed radially outward toward and through the perforations 4. The flow through any perforation must be sufficient to draw the ball sealer 10 to the perforation before the ball sealer sinks past that perforation. If the flow of the treating fluid through the various perforations does not draw the ball sealer to a perforation by the time the ball sealer sinks past the lowest perforation, the ball sealer will simply sink into the rathole 8 where it will remain.

In contrast, the present invention contemplates the use of ball sealers 10 having a density less than the density of the treating fluid. Within the wellbore, each ball sealer has a velocity comprised of two opposing components. The first velocity component is directed vertically upward due to the buoyancy of the ball sealer in the fluid. The second velocity component is attributable to the drag forces imposed upon the ball sealer by the motion of the fluid shearing past the ball sealer. Above the perforations, this second velocity component will be directed generally downward. It is essential that the downward fluid velocity in the production tubing 6 and in the casing 2 above the perforations 4 be sufficient to impart a downward drag force on the ball sealers which is greater in magnitude than the upward force of buoyancy acting on the ball sealers. This results in the ball sealers being carried downward to the section of the casing which has been perforated.

When ball sealers are utilized in accordance with the present invention, they will never remain in the rathole 8; that is, below the lowest perforation through which the treating fluid is flowing, due to the buoyancy of the ball sealers. Below the lowest perforation accepting the treating fluid, the fluid in the wellbore remains stagnant. So, there are no downwardly directed drag forces acting on the ball sealers to keep them below the lowest perforation taking the treating fluid. Hence, the upward buoyancy forces acting on the ball sealers will dominate in this interval.

Therefore, the practice of the present invention results in the vertical velocity of each ball sealer being a function of its vertical position within the casing. At least below the lowest perforation, and possibly higher if little fluid is flowing down to and through the lower perforations, the net vertical velocity of each ball sealer will be upward due to the dominance of the buoyancy force over any downward fluid drag force. At least above the highest perforation, and possibly lower if little fluid is flowing through those higher perforations, the net vertical velocity of each ball sealer will be downward due to the dominance of the downward fluid drag force over the buoyancy force.

The ball sealers having a density less than the density of the treating fluid will remain within, or moving toward, that portion of the casing between the uppermost perforation and the lowermost perforation through which fluid is flowing until the ball sealers seat upon a perforation. While suspended within that portion of the casing, the motion of the fluid radially outward into and through the perforations will exert drag forces on the ball sealers to move them radially outward to the perforations where they will seat and be held there by the pressure differential.

The net result of the use of the present invention is that the ball sealers injected into the well and transported to the perforated zone of the casing will always seat upon and plug the perforations through which fluid is flowing with an invariable 100% efficiency. That is, each and every ball sealer will seat and plug a perforation as long as there is a perforation through which fluid is flowing and the flow of fluid down the casing above the uppermost perforation is sufficient to impart a downward drag force on each ball sealer greater in magnitude than the buoyancy force acting on that ball sealer.

When the treatment has been completed and the pressure differential relieved or reversed, the ball sealers will unseat from the perforations. With ball sealers having a density less than the treating fluid, in accordance with the present invention, all ball sealers will naturally migrate upward. Therefore, some means should be provided to catch these ball sealers before they pass into equipment which they might clog or damage. A ball catcher 30 which will accomplish this is depicted in FIG. 2.

Figure 2:
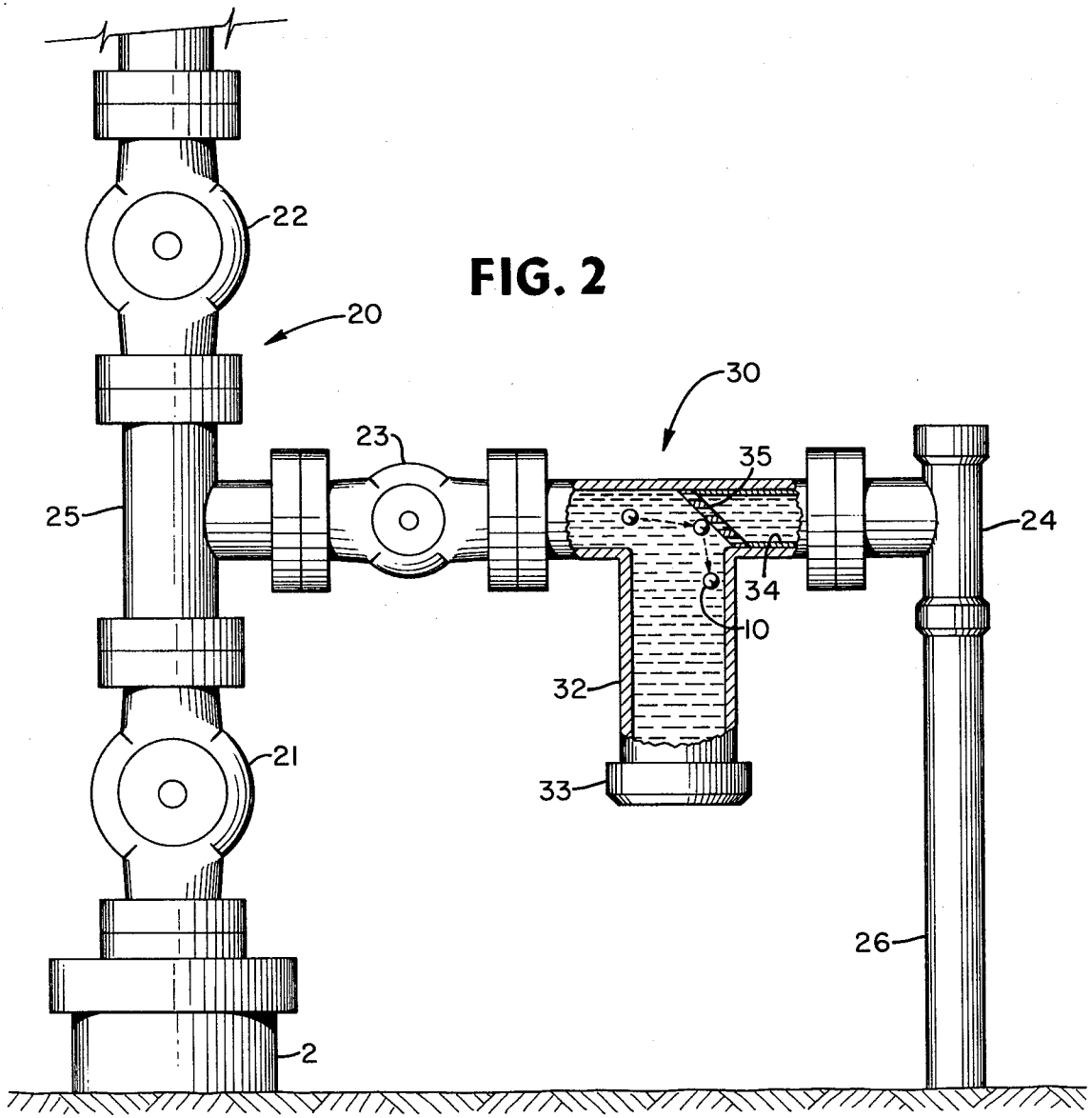
FIG. 2 is an elevation view partially in section of a typical arrangement of wellhead equipment placed on a production well to control the flow of hydrocarbons from the well including a ball catcher adapted to trap the ball sealers upstream of any equipment which they might clog or damage.

FIG. 2 shows a typical arrangement of wellhead equipment for a producing well. The well casing 2 extends slightly above the ground level and supports the wellhead 20. The production tubing 6 is contained within the casing 2 and connects with the lower end of the master valve 21. The master valve 21 controls the flow of oil and gas from the well. Above the master valve 21 is a tee 25 which provides communication with the well either through the crown valve 22 or the wing valve 23. Various workover equipment can be attached to the upper end of the crown valve 22 and communication between that equipment and the well is accomplished by opening the crown valve 22 and master valve 21. Ordinarily the crown valve 22 is maintained in a closed position. Production from the well flows from the tee 25 laterally into the wing valve 23. The wing valve 23 directs the flow of fluids from the wellhead to the gathering flowline 26.

A ball catcher 30, shown in section, is located downstream of the wing valve and upstream of the flow controlling choke 24. The produced fluid will pass through the ball catcher 30 but the ball sealers will be trapped therein. After the produced fluid passes through the choke 24 it moves into a gathering flowline 26 which will typically transport the fluid to a separation facility and then either to holding tanks or to a pipeline.

The ball catcher 30 is basically a tee having a deflector insert 34 containing a deflector grid 35 inserted into the downstream end of the tee. The deflector grid 35 allows fluid to pass through it but it will not allow objects the size of the ball sealers to proceed further downstream. Preferably the deflector grid 35 is angled within the ball catcher 30 so that when the ball sealers strike the deflector grid 35, they will be deflected into the tee's deadleg 32. A deadleg cap 33 is attached to the lower end of the deadleg 32 and can be easily removed, when the wing valve is closed and the pressure bled down, to allow the removal of the trapped ball sealers.

Experiments were conducted to test the seating efficiencies of ball sealers utilized according to present practices, i.e., ball sealers having a density greater than the treating fluid, and ball sealers utilized according to the present invention, i.e., ball sealers having a density less than the density of the treating fluid.

The laboratory experiments were designed to simulate ball sealers seating on perforations in a casing. The experimental equipment included an 8-foot long piece of 3-inch lucite tubing to represent a piece of casing. The lucite tubing was mounted vertically in the laboratory and its lower end sealed closed. Between 3 and 4 feet from the bottom of the tubing, five vertically aligned holes were drilled through the wall of the tubing to represent perforations. The holes were ⅜-inch in diameter and spaced 2-inches apart on center.

A 90° elbow was placed on the upper end of the lucite tubing and was connected by a flowline to a pump. The pump drew fluid from a reservoir tank and pumped it at various controlled rates through the flowline and into the upper end of the tubing. The fluid flowed down the lucite tubing, through the perforations and returned by a flowline to the reservoir tank.

To inject the ball sealers a suitable hole was made in the elbow and a 1-inch diameter piece of tubing welded in the hole. The end of the 1-inch tubing was centered to be coaxial with the lucite tubing at the upper end of the lucite tubing. The ball sealers were introduced into the lucite tubing through the 1-inch tubing.

The flow of fluid into the upper end of the lucite tubing was measured. It was assumed that the flow through each perforation was the same and therefore the flow through each perforation was taken to be 1/5 of the measured flow into the upper end of the lucite tubing.

During the experiments, water, having a density of 1.0 grams per cubic centimeter (g/cc), was used as the fluid. Rigid ball sealers were made from four different materials having different densities. The balls were all ¾ inches in diameter and were made from polypropylene (0.84–0.86 g/cc density), nylon (1.11 g/cc density), acetal (1.39 g/cc density) and teflon (2.17 g/cc density). These ball sealers did not have an elastomeric cover. In practice, ball sealers are usually covered with an elastomer, such as rubber, so that they effect a better seal, but the purpose of these experiments was to observe seating characteristics and not sealing characteristics.

The experiment generally involved establishing a specific flow rate of the fluid through the perforations, injecting the ball sealers through the 1-inch tubing into the upper end of the 8-foot lucite tubing and observing whether or not the ball sealers seated on the perforations. The experimental program was conducted with ball sealers made of all four materials being injected into the tubing with the water flowing through it.

A single set of tests involved injecting ten balls of the same material, one at a time, into the top of the 8-foot lucite tubing. An observation was made whether or not the ball sealer seated on one of the perforations. If a ball seated on a perforation, that ball was released from the perforation prior to dropping the next ball, so that there were always five open perforations for each ball to seat upon. During a single set of tests the fluid and its flow rate remained unchanged. After all ten balls had been dropped, the number that seated upon perforations was defined as the seating efficiency under those conditions and expressed as a percentage.

Six or seven tests were conducted to define a regression curve plotting seating efficiency against flow rate through a perforation for that particular ball sealer and fluid. These regression curves were constructed for each set of equal density ball sealers. The data from those regression curves was then used to make the graph of FIG. 3.

Figure 3:
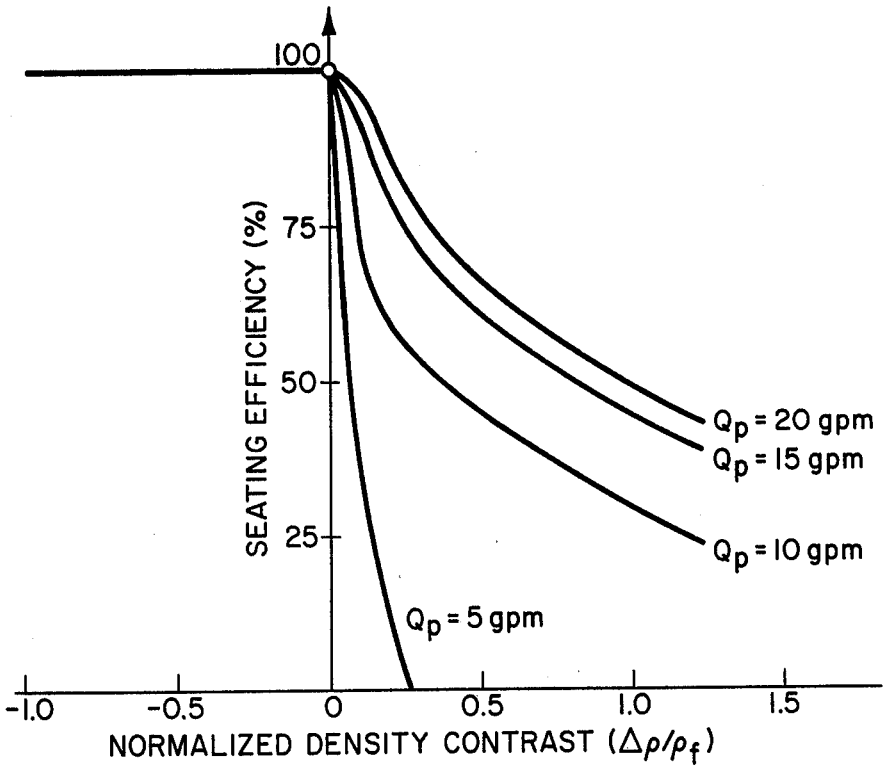
FIG. 3 is a graph of the seating efficiency versus the normalized density contrast between a ball sealer and a treating fluid based on experiments.

FIG. 3 is a plot of seating efficiency versus the normalized density contrast. The normalized density contrast is the difference in density between the ball sealer and the fluid divided by the density of the fluid. A positive normalized density contrast means the density of the ball sealer is greater than the density of the fluid and a negative normalized density contrast means the density of the ball sealer is less than the density of the fluid. It follows that a normalized density contrast of zero means that the ball sealer and the fluid have the same density.

When the normalized density contrast is greater than zero, the seating efficiency was found to be a function of the flow through the perforations. In FIG. 3 there are four plots of seating efficiency versus normalized density contrast for four different flow rates through a perforation, 20 gallons per minute (gpm), 15 gpm, 10 gpm, and 5 gpm. Also, the seating efficiency was found to increase as the normalized density contrast decreased toward zero.

When the normalized density contrast is less than zero, the seating efficiency is always 100% provided that the flow of fluid downward within the casing above the perforations is sufficient to impart a downward drag force on the ball sealers which is greater in magnitude than the upward buoyancy force acting on the ball sealers. In other words, if the downward flow of fluid within the casing is sufficient to transport the ball sealers downward to the perforations, they will always seat.

It is a rather unique situation when the normalized density contrast equals zero. As noted above, the normalized density contrast is zero when the density of the ball sealer is the same as the density of the fluid. There were no tests conducted wherein the ball sealers had the exact same density as the fluid, but it appears from the rest of the data that the seating efficiency for a normalized density contrast of zero should be close to 100%. The seating efficiency may be slightly less than 100% since there exists the theoretical possibility of a ball sealer not seating. This could occur should the ball sealer be carried downward by the fluid to the level of the lowermost perforation without the ball seating and should the ball subsequently travel below the level of the lowermost perforation due to its inertia. It is conceivable that a ball sealer that overshoots the lowermost perforation due to its inertia will remain suspended in the rathole without seating if the flow of fluid down the casing and through the perforations does not cause enough turbulence below the lowermost perforation to somehow move that ball sealer upwards. This situation is not possible if the ball sealers are less dense than the fluid since the buoyancy of the ball sealers will cause them to rise at least to the level of the lowermost open perforation taking fluid.

When the normalized density contrast is greater than zero, i.e., the density of the ball sealers being greater than the density of the fluid, the seating efficiency of the ball sealers is a function of the flow rate through the perforation and the difference in density between the ball sealers and the fluid. The greater the flow rate through the perforation and the less difference in density between the ball sealers and the fluid, the greater the seating efficiency will be. The seating efficiency of ball sealers having a density greater than the density of the fluid is always a statistical phenomenon. A variation in the number, spacing and orientation of the perforations is highly likely to affect the precise seating efficiency which can be expected in that situation. Therefore, since the seating of ball sealers having a density greater than the density of the fluid is always a statistical phenomenon, there is always the possibility that too few or too many of the ball sealers will seat to get the desired diversion.

Practicing ball sealer diversion according to the present invention, i.e., the use of ball sealers having a density less than the density of the fluid, will result in 100% seating efficiency irrespective of the flow rate through the perforations and irrespective of the magnitude of difference in density between the ball sealers and the fluid. The seating efficiency of the ball sealers having a density less than the density of the fluid is only a function of the downward flow of fluid above the uppermost perforation in the casing. If the downward flow within the casing can transport the ball sealers to the level of the perforations, then the ball sealers will seat. A predictable diversion process will occur since the number of perforations plugged by the ball sealers will be equal to the lesser of the number of ball sealers injected into the casing, or the number of perforations accepting fluid.

Figure 4:
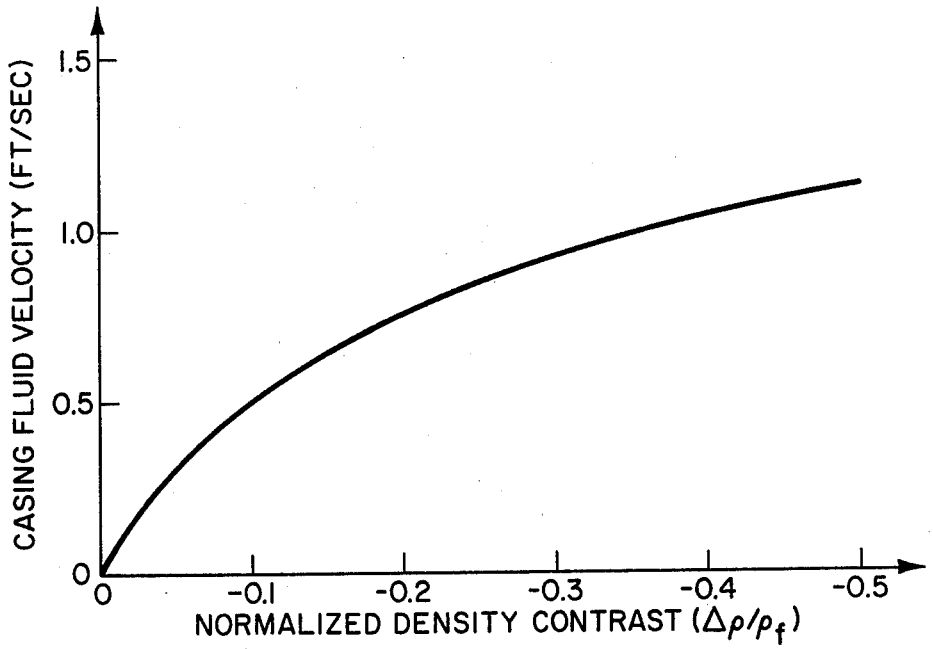
FIG. 4 is a graph of the fluid velocity within the casing versus the normalized density contrast between a ball sealer and a treating fluid based on experiments.

The relationship between the normalized density contrast and the fluid velocity needed to transport the ball sealers down the casing was investigated. FIG. 4 is a graph of the normalized density contrast between the ball sealers and the fluid plotted against the velocity of the fluid downward within the casing. This graph is based on several tests which involved placing a ball sealer within a vertical piece of lucite tubing and flowing fluid downward through the tubing. The velocity of the fluid was adjusted until the ball sealer was maintained in a fixed position at the mid-point of the tubing.

In that equilibrium position the drag forces of the fluid shearing past the ball sealer were equal in magnitude to the buoyancy forces acting on the ball sealer. Ball sealers of several densities were used in conjunction with two fluids, water and 1.13 g/cc calcium chloride brine, to give the plot of FIG. 4.

The solid line defines the equilibrium condition wherein the ball sealer will remain stationary within the casing, moving neither upward nor downward. Below the line in FIG. 4 the velocity of the fluid in the casing would be insufficient to overcome the force of buoyancy and the ball sealers will rise in the casing. Above the line in FIG. 4 the velocity of the fluid in the casing exerts a drag force on the ball sealers greater in magnitude than the force of buoyancy acting on the ball sealers. Therefore, the ball sealers will be transported down the casing.

All points on the line and below it correspond to a certain normalized density contrast and a certain casing velocity which will result in a seating efficiency of zero percent. Because the ball sealers are not transported down to the perforations, they cannot seat. Whereas, if the normalized density contrast and casing velocity define a point above the line plotted in FIG. 4, the seating efficiency will be 100%. If the ball sealers are transported to the perforations, they will seat. Their buoyancy will maintain them at a position at or above the lowermost perforation and the downward fluid velocity in the casing above the uppermost perforation will maintain the ball sealers at or below the level of the uppermost perforation. It will take a very small fluid flow through a perforation to draw a ball sealer to the perforation and seat it thereon when the amount of time the fluid flow through the perforation has to act upon the ball sealer is limited only by the length of the injection time.

To apply the present invention in the field, it is necessary to have a ball sealer which has a density less than the wellbore fluid and at the same time has the strength to withstand the pressures encountered in the wellbore. It is not unusual for the bottom hole pressure to exceed 10,000 psi and even reach 15,000 psi during a well treatment. If a ball sealer cannot withstand these pressures, they will collapse causing the density of the ball sealer to increase to a density which can easily exceed the fluid density.

Since fluids used for treating wells generally have densities ranging from approximately 0.8 grams per cubic centimeter (g/cc) to significantly above 1.1 g/cc, a series of light weight ball sealers are required having densities in the same 0.8 to 1.1 g/cc range.

Suitable materials are currently available for use in conjunction with ball sealers in the 1.1 g/cc range and greater. In the range from 0.8 to 1.1 g/cc, techniques at manufacturing such ball sealers have not been very satisfactory. For example, there is one commercially available BUNA-N covered ball sealer having a phenolic core with considerable void volume which can have a density less than 1.0 g/cc. Since the void volume in the phenolic core is created by partially consolidating a phenolic resin using low pressure molding conditions, control of the density is extremely difficult. A representative sample was tested and proved to have an average density of 0.996 g/cc and a wide distribution (0.908 to 1.085 g/cc). Moreover, when these ball sealers were hydrostatically pressure tested, it was found that in many of the ball sealers the void volumes were unstable and had collapsed when subjected to hydrostatic pressures as low as 6,000 pounds per square inch. Correspondingly, when these void volumes collapsed, the density of the ball sealers increased.

Figure 5:
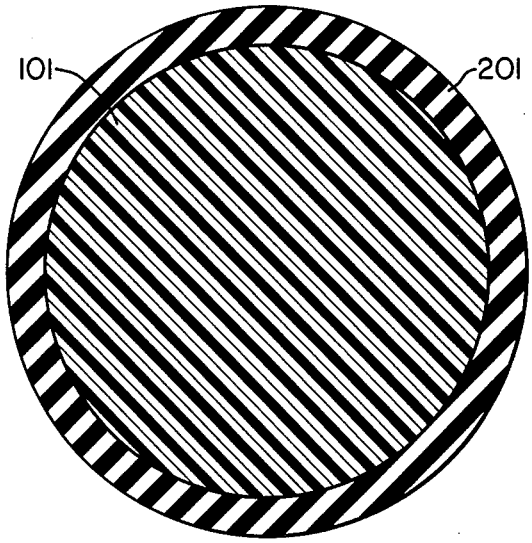
FIG. 5 is a view of a ball sealer in section.

A ball sealer capable of withstanding great pressures and having a density in the 0.8 to 1.1 g/cc range is depicted in FIG. 5. The spherical ball sealer 10 has a spherical core 101 made of syntactic foam covered with an elastomeric material 201.

Syntactic foam is a material system comprised of hollow spherical particles dispersed in some form of binder. The commercially available low density syntactic foams which appear to be sufficiently strong to withstand the pressures and temperatures typically encountered by ball sealers, consist of microscopically small, hollow glass spheres (averaging approximately 50 microns in diameter) dispersed in a resin binder such as epoxy. It is anticipated that in the future it may become possible in syntactic foam systems to use spheres made from materials other than glass and binders made from materials such as thermoplastics and thermosetting plastics. In fact, Emerson and Cuming Inc. has recently developed high strength glass microspheres which can withstand high pressures of the magnitude typically encountered during injection molding. If injection molding can be used to make ball sealers, it will be possible to use a lightweight thermoplastic or thermosetting plastic as the binder resulting in a high strength ball sealer having a very low density.

Several of the commercially available syntactic foams which appear to be suitable for use as the core material of a low density ball sealer are listed in Table I.

TABLE I

PROPERTIES OF VARIOUS SYNTACTIC FOAM SYSTEMS

| Product | Manufacturer | Density (g/cc) | Hydrostatic Compressive Strength (psi) | Bulk Modulus (psi) |
|---|---|---|---|---|
| EL 30 | Emerson & Cuming | 0.48 | 8,000 | 250,000 |
| EL 36 | Emerson & Cuming | 0.57 | 16,000 | 390,000 |
| EL 39 | Emerson & Cuming | 0.62 | 24,000 | 420,000 |
| EF 38 | Emerson & Cuming | 0.60 | 7,000 | Not Available |
| 34-2C6 | Lockheed | 0.54 | 18,000 | Not Available |
| 36-1B4 | Lockheed | 0.57 | 13,650 | Not Available |
| 39-1B5 | Lockheed | 0.62 | 15,600 | Not Available |
| XP-241-36 | 3M | 0.57 | 11,000 | 325,000 |
| XP-241-42H | 3M | 0.57 | 20,000 | 450,000 |

The syntactic foams listed in Table I show very good strength when subjected to hydrostatic compression. Many of the materials will easily withstand 15,000 psi. Furthermore, each of the syntactic foams for which the bulk modulus of elasticity was available has a bulk modulus of elasticity comparable to that of water, which is 300,000 psi.

The bulk modulus of elasticity is the inverse of material compressibility. It represents a material's resistance to volumetric change as a function of hydrostatic pressure. For example, if the bulk modulus of a material is greater than that of water, the material will be less compressible than water. Hence, the material's buoyancy will increase with respect to the water when both are being subjected to the same pressure since the water will be compressed more. This quality of these syntactic foams will assure that the density of the ball sealers remains less than the density of the treating fluid, thereby, avoiding the problems encountered with the phenolic core ball sealers.

Syntactic foam is currently available only in blocks with a standard volume of approximately 1 cubic foot. Therefore, the first step in the fabrication of syntactic foam ball sealers is to machine the syntactic foam blocks to produce ¾-inch diameter syntactic foam spheres. The spheres are then surface prepped, coated with a suitable bonding agent and covered with the desired covering.

Surface preparation involving some cleaning technique is required to assure the best possible bond between the covering and the syntactic foam. It is most desirable if surface preparation can be limited to a strong air blast which will remove most of the crushed glass and debris created during machining. Sand blasting has been used with very good success but its use should be limited to very brief treatments due to rapid abrasion of the core which leads to increased ball density as well as a highly variable batch density. If the spheres have been handled or are oily, a trichlorylethelene wash has been used satisfactorily. Once the spheres are grease and oil free, they can be dipped in a suitable bonding agent selected according to the covering material to be used.

Rubber can be used as the elastomeric covering material. After the uncured rubber cover has been compressed around the foam balls with an arbor press, the balls are ready for molding. The exact temperature, pressure, and cure time will vary with rubber compounds. Curing processes are old and known in the art.

The critical parameter in the curing process with respect to syntactic foam ball sealers is the temperature. Since the cure temperatures are generally held for about ½ hour at around 300° F for the BUNA-N or epichlorohydrin rubber compounds, it is imperative that the syntactic foam binder is formulated to be heat compatible.

All of the manufacturers of the syntactic foam systems listed in Table I have epoxy binder systems using suitable hardeners, such as anhydrite, which do not soften or decompose at these elevated temperatures (around 300° F). The only polyamide binder system tested was EF 38 (Table I), and it was found to be unsuitable when subjected to temperatures greater than 250° F.

While Table I lists the densities of those selected syntactic foam materials, the overall density of a ball sealer is determined by both the core material and the cover material. Table II sets forth the statistics, including the overall ball density, of four groups of rubber-covered syntactic foam ball sealers which have been manufactured.

TABLE II

MANUFACTURED RUBBER COVERED SYNTACTIC FOAM BALL SEALERS

| Quantity | Average Density (g/cc) | Size | F. H. Maloney Co. Rubber Compound | Syntactic Foam |
|---|---|---|---|---|
| 275 | .879 | ⅞" | 490 FB | Lockheed 36-1B4 |
| 242 | .994 | ⅞" | 483 | Lockheed 36-1B4 |
| 237 | .898 | ⅞" | 490 FB | Lockheed 36-1B4 |
| 175 | .832 | 1¼" | 490 FB | Lockheed 36-1B4 |

Initial screening tests carried out on the manufactured syntactic foam ball sealers have shown them to be mechanically stable when subjected to a 1500 psi differential pressure across simulated perforations and when subjected to temperatures on the order of 170° F. Furthermore, when subjected to hydrostatic pressures, these ball sealers did not begin to fail until pressures of approximately 13,500 psi were reached. At that time they began to fail inelastically due to the collapse of the syntactic foam. Failure at this pressure corresponds extremely well with the manufacturers stated hydrostatic compressive strength of 13,650 psi (see Table I, Lockheed 36-1B4).

Although syntactic foam is one ball sealer core material, certain thermoplastics can be used. Although no unfoamed plastics exhibit sufficiently low densities to make a 0.8 to 0.9 g/cc ball sealer, polymethylpentene can be used as a core material for ball sealers in the 1.0 g/cc density range. Polymethylpentene has a density of .83 g/cc and is a high temperature thermoplastic (melting point approximately 250° C). All other lightweight plastics, which typically include polybutylene, polyethylene, polypropylene, and polyallomer copolymers, are nearly twice as heavy as is acceptable. Furthermore, since these materials are low temperature thermoplastics, they are probably not suitable for ball sealer cores from the standpoint that they are likely to extrude through the perforations under the bottom hole temperature and pressure conditions typically encountered.

The principle of the invention and the best mode in which it is contemplated to apply that principle have been described. It is to be understood that the foregoing is illustrative only and that other means and techniques can be employed without departing from the true scope of the invention defined in the claims.

I claim:

1. A method for treating a subterranean formation surrounding a casing having at least two perforations comprising:

injecting a treating fluid into the casing to cause a flow of fluid through at least one of the perforations and into the formation;

thereafter, injecting into the casing treating fluid carrying a ball sealer having a syntactic foam core and an elastomeric cover, the ball sealer having a size sufficient to plug a perforation and having a density less than the density of the treating fluid being injected into the casing, the injection of the treating fluid into the casing being at a rate sufficient to carry the ball sealer down the casing and substantially sealing one of the perforations; and thereafter, injecting the treating fluid into the casing to cause a flow of fluid through the perforation which the ball sealer did not seat upon.

2. A method of plugging the perforations in a casing which has been set in a wellbore comprising:

downwardly flowing into said casing a carrier liquid having ball sealers suspended therein, said ball sealers having syntactic foam cores and elastomeric covers, said ball sealers having a density less than the density of the carrier liquid and being of sufficient size to plug the casing perforations; and maintaining the flow velocity of said carrier fluid at a rate sufficient to overcome the buoyancy of said ball sealers and sufficient to transport said ball sealers to the perforations.

3. A method for treating a subterranean formation surrounding a perforated casing which has been set in a wellbore comprising:

downwardly flowing a fluid within the casing and through the perforations into the formation surrounding the perforated parts of the casing;

injecting into the casing ball sealers having syntactic foam cores and elastomeric covers, said ball sealers having a size sufficient to plug the casing perforations and having a density less than the density of the downwardly flowing fluid within the casing; and, thereafter, continuing the downward flow of the fluid within the casing but at a rate such that the downward velocity of the fluid in the casing above the perforations is sufficient to impart a downward drag force on the ball sealers greater in magnitude than the upward buoyancy force acting on the ball sealers thereby transporting the ball sealers to the perforations.

4. A ball sealer for plugging perforations in a casing which has been set in a wellbore comprising:

a. a syntactic foam core, said syntactic foam being a material system comprised of hollow spherical particles dispersed in a binder; and b. an elastomeric covering.

5. In a method of sequentially treating two strata of a subterranean formation surrounding a well casing having a plurality of perforations formed therein wherein ball sealers suspended in the treating fluid are used to seal part of said perforations, the improvement wherein said ball sealers include a syntactic foam core and an elastomeric cover and have a density less than the treating fluid.

6. A method for treating a subterranean formation surrounding a casing having at least two perforations comprising:

injecting a treating fluid into the casing to cause a flow of fluid through at least one of the perforations and into the formation;

thereafter, injecting into the casing treating fluid carrying a ball sealer having a polymethylpentene core and an elastomeric cover, the ball sealer having a size sufficient to plug a perforation and having a density less than the density of the treating fluid being injected into the casing, the injection of the treating fluid into the casing being at a rate sufficient to carry the ball sealer down the casing and substantially sealing one of the perforations; and thereafter, injecting the treating fluid into the casing to cause a flow of fluid through the perforation which the ball sealer did not seat upon.

7. A ball sealer for plugging perforations in a casing which has been set in a wellbore comprising:

a. a core made of polymethylpentene; and b. an elastomeric covering.

8. In a method of sequentially treating two strata of a subterranean formation surrounding a well casing having a plurality of perforations formed therein wherein ball sealers suspended in a fluid are used to seal part of said perforations, the improvement wherein said ball sealers include a polymethylpentene core and an elastomeric cover and have a density less than said fluid.

* * * * *